United States Patent [19]

Oden et al.

[11] 4,190,107

[45] Feb. 26, 1980

[54] WELL BORE APPARATUS WITH HYDRAULICALLY RELEASABLE TUBING SEAL UNIT

[75] Inventors: Jerome H. Oden, Houston; Roy E. Swanson, Jr., Sugar Land; Ronald J. Vondall, Sulphur Springs, all of Tex.

[73] Assignee: Baker International Corporation, Orange, Calif.

[21] Appl. No.: 936,851

[22] Filed: Aug. 25, 1978

[51] Int. Cl.[2] ..... E21B 23/04; E21B 17/02

[52] U.S. Cl. ..... 166/120; 166/125; 285/306

[58] Field of Search ..... 166/120, 123, 125, 181, 166/182, 208; 285/18, 306

[56] References Cited

U.S. PATENT DOCUMENTS

| | | | |
|---|---|---|---|
| 2,409,811 | 10/1946 | Taylor, Jr. et al. | 166/125 |
| 2,978,032 | 4/1961 | Hanna | 166/125 |
| 3,008,523 | 11/1961 | Clark, Jr. et al. | 166/120 |
| 3,035,642 | 5/1962 | Page | 166/72 |
| 3,037,797 | 6/1962 | Braun | 166/181 |
| 3,299,959 | 1/1967 | Brown | 166/120 |
| 3,870,104 | 3/1975 | Mott | 166/208 |
| 3,920,075 | 11/1975 | Braddick et al. | 166/208 |
| 3,934,652 | 1/1976 | Cochran | 166/208 |
| 4,008,759 | 2/1977 | Blackwell | 166/125 |

*Primary Examiner*—James A. Leppink
*Attorney, Agent, or Firm*—Subkow and Kriegel

[57] ABSTRACT

Well bore apparatus is installed in a well casing on a tubular string having a packer anchored in and forming a seal within the casing. In the tubing string above the packer is a safety valve structure held open by the pressure of fluid supplied through control fluid tubing extending to the top of the well between the exterior of the tubing string and the casing. A long tubing seal structure has a lock releasable by the pressure of fluid supplied through the tubing string. The tubing seal structure is released to enable the tubing string to move freely in either direction, in response to pressure and/or temperature changes, whereby tension and compression reversals are eliminated. The tubing string above the sealing receptacle can be pulled from above the packer and other downhole structures. The hydraulic release is operable by fluid pressure to release the receptacle for longitudinal movement relative to a long sealing slick joint.

7 Claims, 6 Drawing Figures

WELL BORE APPARATUS WITH HYDRAULICALLY RELEASABLE TUBING SEAL UNIT

In the completion of certain wells, such as oil or gas wells drilled into the earth and cased to or through the productive formation or formations, it is one practice to set a casing packer above the productive formation and to provide a tubing string between the packer and the production tree at the top of the well to conduct the production fluid from the well. Reversals of loading of the tubing joints can cause loosening of the joints and potential damage and leakage. To avoid such reversals tubing seal connectors have evolved including a sealing receptacle and a long sealing tube or "slick joint", released by manipulation of the tubing string to allow the tubing to be spaced out and slidably and sealingly engaged with the sealing or slick joint, before connecting the tubing to the production tree and bringing the well in by conventional methods, such as displacement of fluid from the tubing or swabbing the well in.

Typically, a permanent packer has been set in the casing by a wireline setting tool, and the tubing is run into the well and latched into the packer by an anchor and sealing structure below a long tubing seal which is mechanically locked together. The long tubing seal can be released to allow spacing the tubing out by manipulation of the tubing string before connection of the tubing string with the production tree. Such operations involving manipulation of the tubing string can cause problems, say, for example, when an automatic safety valve structure is provided in the tubing above the long tubing seal and is controlled by fluid supplied through control tubings extending along the outside of the tubing string within the casing. Tubing manipulation can cause damage to the relatively small control tubings, particularly if the well bore is crooked or deviated at an angle causing engagement of the control tubings with the casing.

The present invention relates to improvements in such well completion apparatus eliminating the necessity for tubing manipulation to release a long tubing seal structure.

In accomplishing the foregoing, a long tubing seal receptacle structure is installed in the tubing string and has a releaseable connection between a long sealing receptacle and a long slick joint or inner sealing tube. The structure includes a fluid pressure operated release mechanism between the housing or receptacle and the sealing, inner tube or slick joint. In the form herein illustrated, the release mechanism responds to the pressure of fluid in the tubing, but in some cases it is advantageous for the release to be responsive to external or annulus pressure, as disclosed in the co-pending application Ser. No. 903,787, filed May 8, 1978, for "Well Bore Apparatus With Annulus Pressure Releasable Tubing Seal Unit" by Kovacs.

In the form shown herein, latch elements carried by an outer receptacle or tubular sealing body are biased outwardly from a groove in the long sealing tube or slick joint, but are initially held in locking positions in the groove by a piston sleeve adapted to be shifted by fluid pressure supplied through the tubing, to a position releasing the latch elements from the groove, so that the outer housing can move upwardly with the upwardly extended tubing string. No rotation of the tubing string is required to accomplish the release.

The packer is run in on the tubing string and can be hydraulically set and anchored before release of the sealing connector by utilizing a sheareable ball seat or other device to blank off the tubing below the packer to cause the packer to be set, before the sealing connector is released.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a* and 1*b*, together, constitute a view diagrammatically illustrating well bore apparatus with hydraulically releasable tubing seal unit in accordance with the invention installed in a well casing, FIG. 1*b* being a downward continuation of FIG. 1*a*;

Figure 1A:
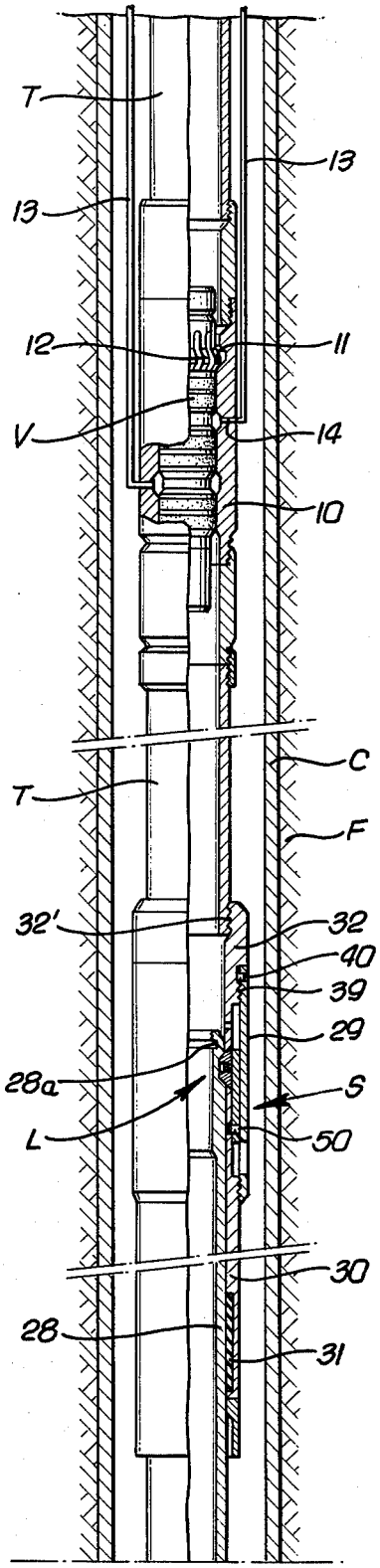
Figure 1B:
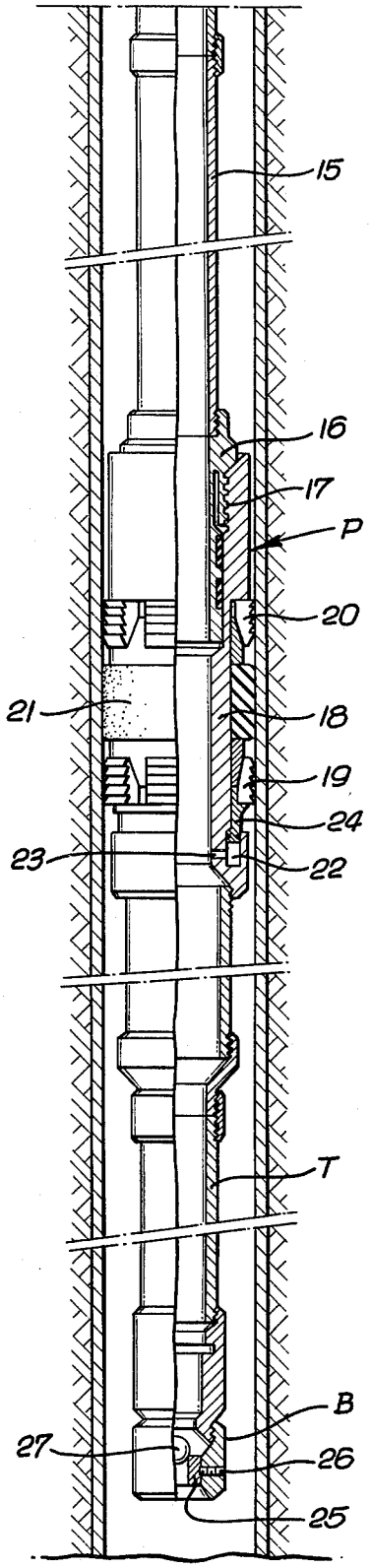

As seen in the drawings, referring first to FIG. 1*a* and FIG. 1*b*, well bore apparatus in accordance with the invention is shown as installed in a well casing C extending downwardly in a well bore drilled into or through earth formation F. The well bore apparatus includes a length of running tubing T adapted to contain the various tubular components to be described hereinafter, and to extend to the top of the well bore, where it can be connected with the usual production well head. Included in the tubular structure beneath the tubing T is a tubular seating nipple or body 10 providing a landing seat 11 in which a wireline retrievable, automatic shutoff or safety valve structure V is installed and retained in place by latch means 12. The valve V is of the type adapted to be maintained in an open condition by the application of control fluid pressure through one of the dual control tubing strings 13, which extend from the seating nipple 10 to the top of the well in the annular space between the tubing T and the casing C. These tubings communicate with the automatic safety or shutoff valve V via passage means 14 in the seating nipple, whereby the automatic shutoff valve can be maintained in an open condition, permitting the flow of production fluid upwardly through the well bore apparatus, to the top of the well. However, when the control fluid pressure in the tubing 13 leading to passage means 14 is released, the automatic shutoff valve closes, to shut the well in. The hydrostatic head of fluid in the other control tubing 13 balances the hydrostatic pressure in the tubing 13 leading to the passage means 14. Such valves may be either of the wireline retrievable type as generally illustrated herein, or may be of the type incorporated within the tubing structure. An example of such a valve structure is illustrated in U.S. Pat. No. 3,971,438, granted July 27, 1976, in the name of Talmadge L. Crowe, for "Wireline Safety Valve with Split Ball".

The control tubing string or strings 13, being external of the upwardly extended tubing string T pose difficulties in operations involving the mechanical setting of packers or releasing of sealing assemblies within the tubular structure below the safety valve seating nipple, particularly in the case of very crooked or deviated bore holes, wherein rotative manipulation of the tubing string can cause damage to the control tubing 13.

Accordingly, within the tubular structure below the valve seating nipple 10 is a long tubing seal assembly S, adapted, as will be later described, to be released in response to applied fluid pressure, without manipulation of the tubing string T.

In the tubular structure below the tubing seal S, at some desired downwardly spaced location determined by the length of spacer tubing 15 which extends downwardly from the sealing receptacle is a well bore packer assembly P of a known type. The illustrative packer is connected to the tubing string by a releasable anchor and tubing sealing nipple assembly 16, also of a known type, by means of threaded latch members 17 engaged within a companion bore of an elongated packer body or inner tubular mandrel 18. The packer assembly P includes normally retracted, downwardly holding lower slip elements 19 expansible outwardly into anchoring engagement with the casing, as well as normally retracted upwardly holding slips 20 expansible outwardly into gripping engagement with the casing C. Between the slip elements 19 and 20 is a resiliently deformable packing structure 21, of elastomeric material adapted to be deformed and resiliently expanded into tight sealing engagement within the well casing C to separate the annular space below the packing structure from the casing above the packing structure. The illustrative packer is adapted to be set by the pressure of fluid applied through the tubing string T to an annular piston chamber 22 within the packer body structure. Fluid entering the piston chamber 22 via suitable radial passageways 23, and acting on an annular piston 24, whereby the respective casing engaging slip elements 20 and 19 are set in anchoring engagement with the well casing and the resilient packing 21 is deformed into sealing engagement with the casing. A specific example of such a packing structure is the model "SAB" retainer production packer of Baker Packers, Houston, Texas. Another example of a packer useful in such an installation is disclosed in the pending application of Talmadge L. Crowe for "Fluid Pressure Set and Released Well Packer Apparatus" Ser. No. 907,121, filed May 18, 1978 which is capable of being set and anchored in a well casing hydraulically, without tubing manipulation, as well as being released hydraulically without tubing manipulation.

Below the packer structure P the tubular assembly may include a suitable length of the tubing string T extending downwardly into the well bore and providing means B enabling pressurization of the tubing string for the purposes of effecting the setting of the packer P, and in accordance with the specific embodiment herein illustrated, the release of the releasable tubing seal unit S. This means B, may be one of a number of devices which, as is well known, provide a seat 25 disposed within the flow passage through the tubular structure, and initially retained in place by suitable shearable members 26. A tripping ball or other closure device 27, is adapted to be dropped through the tubing string from the top of the well, and will seat upon the seating element 25. As will be later described, the pressure acting across the ball 27 and seat 25 shears the screws 26 after completion of the other operations in the tubular structure above the ball seat 25.

The releasable tubing seal unit S will be seen to include an elongated internal sealing mandrel or slick joint 28 telescopically extending into an outer tubular body 29 having a downwardly extended elongated sealing section 30, provided internally, at a suitable number of longitudinally spaced locations with circumferentially extended packing means or units 31 which slidably and sealingly engage the cylindrical slick joint 28. Latch means generally denoted at L initially interconnect the inner mandrel or slick joint 28 with the outer body structure 29, retaining them against telescopic movement. However, at the desired time, following the performance of various operations to be hereinafter described, the latch means L are releasable by fluid pressure to allow telescopic upward extension of the outer housing structure 29 with respect to the inner mandrel or slick joint 28.

Figure 2:
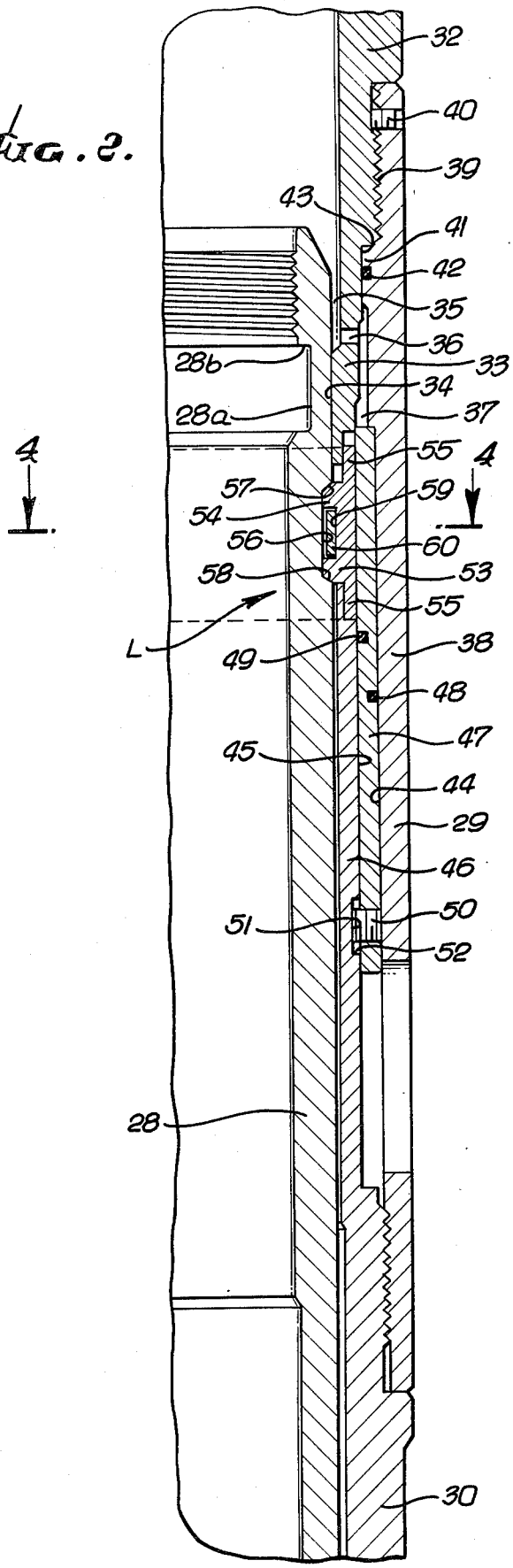
FIG. 2 is a longitudinal quarter section, on an enlarged scale, illustrating the hydraulically releasable latch mechanism in a latched condition.
Figure 4:
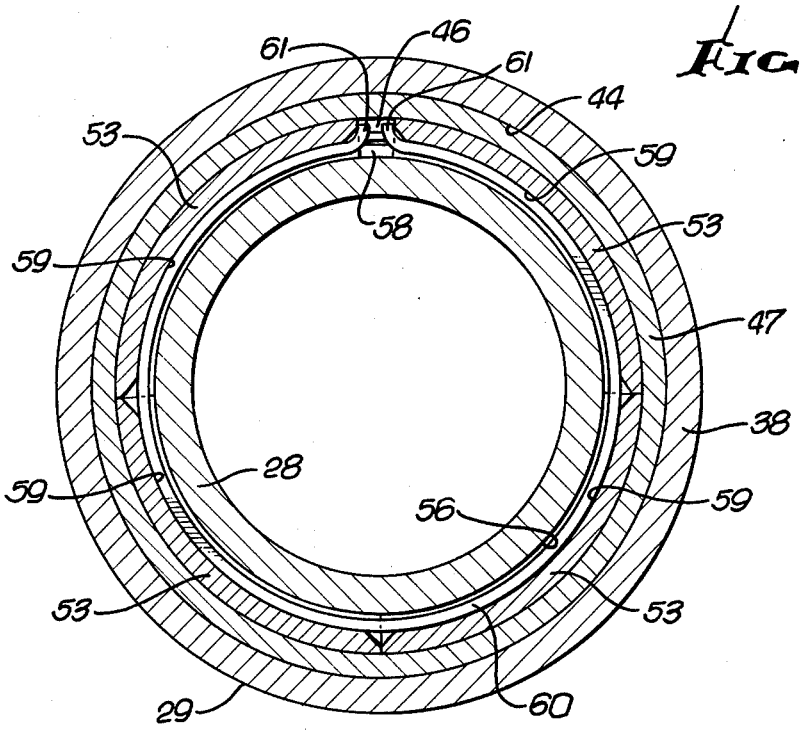
FIG. 4 is a transverse section as taken on the line 4—4 of FIG. 2; and, FIG. 5 is a transverse section as taken on the line 5—5 of FIG. 3.

Referring to FIGS. 2 and 4, the releasable latch means L is shown in the normally latched condition, preventing telescopic movement between the mandrel 28 and the outer body structure 29, so that the tubular structure below the releasable connector is adapted to be run into the well bore to the desired location. The upper body structure includes a connector body 32 of tubular construction having a threaded connection 32' with a section of the tubing string T thereabove. A downwardly extended cylindrical skirt section 33 of the connector 32 extends telescopically over the upper end of the mandrel 28 and has a reduced diameter internal bore 34 which defines with the upper end of the mandrel 28 an annular space 35 communicating with a suitable number of circumferentially spaced radial ports 36 in the skirt 33 providing passage means leading between the interior of the tubing and an annular pressure chamber 37. This pressure chamber 37 is defined between the exterior of the skirt 33 and an elongated, external cylinder sleeve 38, which is threadedly connected at 39 to the connector body 32, and locked in place as by suitable set screws 40. The cylinder sleeve 38 has a cylindrical inner wall section 41 carrying a resilient side ring or O-ring seal 42, sealingly engaged with the external cylindrical surface 43 of the skirt section 33 of the connector. This seal ring 42 closes the upper end of the pressure chamber 37, above the radial passage means 36.

Below the pressure chamber 37, is an annular, cylindrical space defined between the inner cylindrical wall 44 of the cylinder sleeve 38 and the outer cylindrical wall 45 of the upwardly extended section 46 of the elongated sealing section 30. Reciprocable in the annular space defined between the cylindrical walls 44 and 45 is an annular latch piston 47, carrying suitable outer and inner side ring or piston ring seals 48 and 49 respectively slidably and sealingly engaged with the cylindrical walls 44 and 45. Suitable shearable means such as pins or shear screws 50 are carried adjacent the lower end of the annular piston 47 and extend into a recess 51 providing an upwardly facing shear shoulder 52, whereby upon downward movement of the piston 47 the shear pins 50 are enabled to be sheared, upon the application of sufficient fluid pressure to the annular area of the piston 47 between the cylindrical walls 44 and 45.

When the latch piston 47 is in the upper position of FIG. 2, it confines within its inner periphery, normally expansible latch elements 53 which are in the form of generally T-shaped ring segments. Each ring segment has an arcuate body section 54 having axially extended upper and lower annular flanges 55 which engage within the inner periphery of the latch piston 47, when piston 47 is in the upper, latching position of FIG. 2. The body section 54 of each segment 53 extends inwardly into a circumferentially extended groove 56 provided within the outer periphery of the mandrel 28 and providing a downwardly facing annular shoulder 57 and an upwardly facing annular shoulder 58, engageable by the latch body sections 54, when the latch segments are in their inner positions as shown in FIGS. 2 and 4. Each latch segment has an internal inwardly opening groove 59 which receives a circumferentially extended normally expansible spring element 60. As seen in FIG. 4, the spring element 60 is generally C-shaped and has outwardly extended end sections 61 engageable with the adjacent ends of a pair of the latch segments 53.

Figure 3:
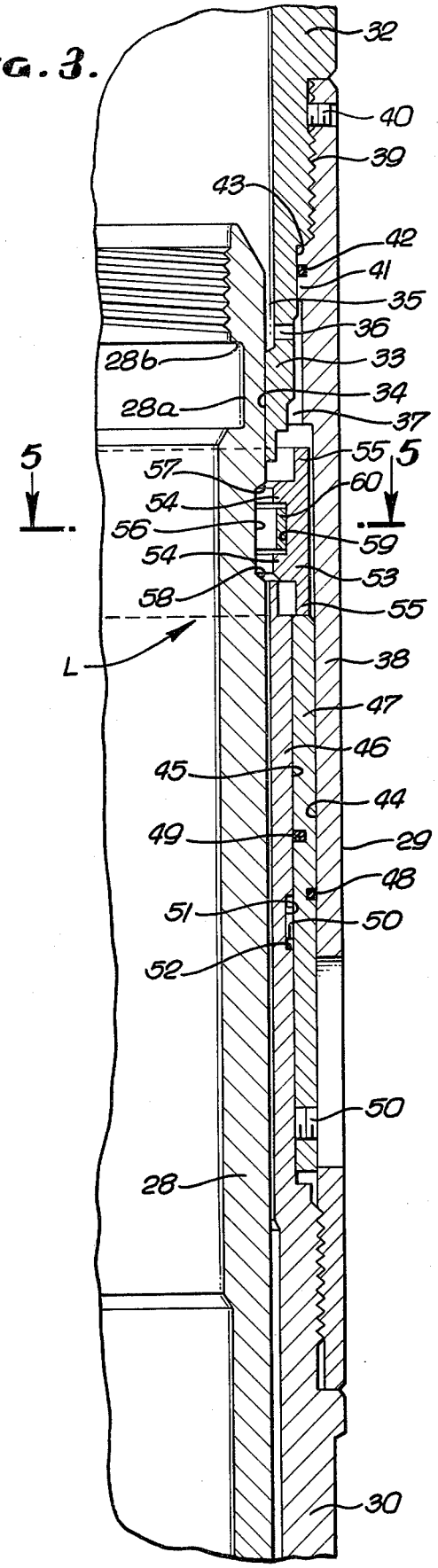
FIG. 3 is a view corresponding to FIG. 2 but showing the latch mechanism released.
Figure 5:
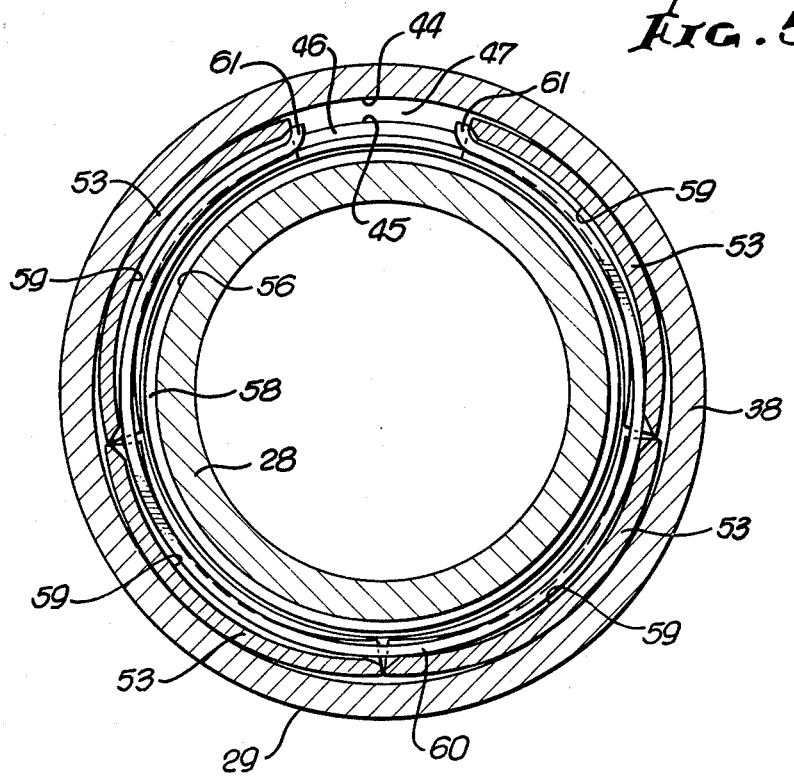

As seen in FIGS. 3 and 5, when pressure fluid is applied through the passage means 36 to the piston chamber 37, the fluid acts upon the annular latch piston 47, forcing the same downwardly, causing the shear pins 50 to be sheared, and freeing the latch segments 53 for outward expansion, to the positions best seen in FIG. 5, so that the body section 54 of the segments clear the respective downwardly and upward facing shoulders 57 and 58 on the mandrel 28. With the latch segments in the outwardly expanded positions, it is apparent that the outer and upper housing structure 29 is then freed for upward movement with respect to the sealing mandrel or slick joint 28, so that the upwardly extending tubing string section can be appropriately vertically positioned within the casing, say for the landing of the upwardly extending tubing string in an appropriate tubing hanger at the well head.

In the use and running of the apparatus described above, the equipment is progressively made up in the tubular string structure as necessary and desired and progressively lowered in the well casing. In the case of the wireline tubing valve V, the valve unit is not installed in the seating nipple 10, but the control tubing 13 is lowered along with the upwardly extending tubing string from an appropriate reel and progressively secured to the tubing string, as the tubular structure is lowered in the casing and the well head equipment is set. At this time the fluid within the well bore can be displaced by the circulation of fluid downwardly through the tubing and upwardly through the tubing casing annulus. With the control tubing 13 closed off, the seating ball 27 can be dropped into the tubing string or circulated down the tubing to seat on the displaceable ball seat 25. In the illustrated installation, the packer structure P is adapted to be set at an initial pressure, lower than the pressure required to release the latch means L and displace the ball seat 25. After the packer has been set, fluid pressure can be applied to the annulus to test the packer. Thereafter, the pressure is increased to activate the latch means L of the sealing receptacle S, thereby enabling the upper body structure 29 to telescope relative to the sealing mandrel or slick joint 28, so that reversals of compression or tension cannot be transmitted through the tubing structure. At this time, the pressure can be further increased to shear out the ball seat 25 which falls to the bottom of the well and opens the tubing structure to enable production of the well. Prior to placing the well on production, the valve means V is run in and landed in the seating nipple 10 on a wireline tool, the latter then being retrieved, and utilizing normal valve operating procedures, the valve means V is opened to allow the well to be placed on production.

Within the mandrel 28 of the tubing seal structure S is an internal groove **28*a* providing a downwardly facing shoulder 28*b*** adapted to be engaged and to retain in place the usual blanking plug, in the event that the upwardly extended tubing string and associated valve structure is to be pulled from the well.

From the foregoing it will now be apparent that the present invention provides a novel well bore apparatus, whereby the production packer can be lowered into a setting position in the well casing, set and anchored, the tubing seal hydraulically released, and the well placed on production, all without requiring rotative manipulation of the tubing string.

We claim:

1. Well bore apparatus adapted to be installed in a well casing for conducting produced well fluid to the top of the well, comprising: a tubing string extending into the casing; packer means in said tubing string having normally retracted expansible casing engaging anchor means and resilient packing deformable into sealing engagement with the casing; and a releasable sealing connector in said tubing string above said packer means; said connector including a pair of telescopically interengaged inner and outer tubular sealing bodies; one of said bodies being connected with said packer means and the other of said bodies being connected with the upwardly extended tubing string; releasable latching means retaining said bodies in a telescopically contracted condition; and fluid pressure responsive release means operable to release said latching means enabling telescopic extension of said bodies; said packer means having setting means responsive to a first pressure of fluid in said tubing string for expanding said anchor means and deforming said packing; said release means having means responsive to a second pressure higher than said first pressure of fluid in said tubing string to release said latch means; and means for temporarily closing said tubing string below said packer means to allow increase of pressure in said tubing string from said first to said second pressures.

2. A releasable telescopic seal structure for releasably connecting a well bore packer in a running string of tubing, comprising: a pair of telescopically engaged tubular members including an external receptacle and an inner sealing mandrel; said members having means connectable in a tubular string for disposition in said tubing string in a well bore; means sealingly and slidably engaged between said receptacle and mandrel; normally released latch means releasably latching said receptacle and said mandrel together; latch retaining means for said latch means including a fluid pressure responsive piston; means defining between said members a pressure chamber; and passage means extending from said pressure chamber to one of the interior of said mandrel and the exterior of said receptacle for conducting operating fluid pressure to said pressure chamber; said latch means including a plurality of circumferentially spaced latch segments having projections thereon; one of said receptacle and said sealing mandrel having a peripheral recess; means resiliently biasing said segments from said recess; said latch retaining piston being shiftable from a first position retaining said projections in said recess to a second position releasing said segments for movement of said projections from said recess.

3. A releasable telescopic seal structure for releasably connecting a well bore packer in a running string of tubing, comprising: a pair of telescopically engaged tubular members including an external receptacle and an inner sealing mandrel; said members having means connectable in a tubular string for disposition in said tubing string in a well bore; means sealingly engaged between said receptacle and mandrel normally released latch means releasably latching said receptacle and said mandrel together; latch retaining means for said latch means including a fluid pressure responsive piston; means defining between said members a pressure chamber; and passage means extending from said pressure chamber to one of the interior of said mandrel and the exterior of said receptacle for conducting operating fluid pressure to said pressure chamber; said sealing mandrel having an external peripheral groove, said latch means including segments having portions held in said groove by said latch retaining piston, and means resiliently biasing said segments from said groove.

4. A releasable telescopic seal structure as defined in claim 3; said means biasing said segments from said groove including a partly circular spring disposed within said segments.

5. A releasable telescopic seal structure as defined in claim 3; said passage extending into said piston chamber from the interior of said sealing mandrel.

6. A releasable telescopic tubing seal structure comprising: a tubular outer body structure; a tubular inner body structure having an external groove; a plurality of latch segments carried by said outer body structure and having portions shiftable radially into and from said groove; spring means within said segments biasing said segments outwardly from said groove; said outer body structure having portions defining an annular space; an annular piston in said space; means defining between said body structures a piston chamber at one end of said piston; passage means extending from the interior of said body structures to said piston chamber; and releasable means initially holding said piston in a first position engaging said segments to retain said segments in said groove.

7. A releasable telescopic tubing seal structure as defined in claim 6; including sealing means within said outer body structure slidably and sealingly engaged with said inner body structure.

* * * * *